United States Patent [19]

Morris

[11] 4,308,664

[45] Jan. 5, 1982

[54] WRITING AID

[76] Inventor: Henry Morris, 8 Single Ave., Hutten Heights, Newcastle, Natal, South Africa

[21] Appl. No.: 134,312

[22] Filed: Mar. 26, 1980

[51] Int. Cl.[3] ..... B43L 13/02

[52] U.S. Cl. ..... 33/41 F

[58] Field of Search ..... 33/41 F, 41 R, 42; 401/48

[56] References Cited

U.S. PATENT DOCUMENTS

| | | | |
|---|---|---|---|
| 200,588 | 2/1878 | Walter | 33/41 F |
| 405,650 | 6/1889 | Anderson | 33/41 F |
| 585,008 | 6/1897 | Shaw | 33/41 F |
| 886,346 | 5/1908 | Caldwell | 33/41 F |
| 1,902,865 | 3/1933 | Koester | 33/41 F |
| 3,245,146 | 4/1966 | Rogers | 33/41 F X |

FOREIGN PATENT DOCUMENTS

| | | | |
|---|---|---|---|
| 24981 | 2/1930 | Australia | 33/42 |
| 366511 | 1/1923 | Fed. Rep. of Germany | 33/41 F |
| 1320083 | 1/1963 | France | 33/27 C |
| 209374 | 1/1924 | United Kingdom | 33/41 F |

OTHER PUBLICATIONS

Popular Science–"Pencil Clip used as to Paint Stripe", 7/45, p. 196.

Popular Mechanics–"Pen Modified with a Paperclip to Prevent Blots Under Ruler", 12/57, p. 186.

*Primary Examiner*—Harry N. Haroian

*Attorney, Agent, or Firm*—Richard H. Zaitlen

[57] ABSTRACT

The invention relates to a spacing device for use with a ruler or other straightedge to aid handwriting of a neat and tidy appearance. The device comprises a resilient spacing member mounted on or in a writing implement and adapted to maintain under a first degree of manual pressure a predetermined distance between a writing point of the writing implement and an edge of a stationary ruler device positioned on a surface to be written upon, said spacing member being movable under a second, increased, degree of manual pressure to reduce the distance by a predetermined amount.

7 Claims, 10 Drawing Figures

WRITING AID

BACKGROUND TO THE INVENTION

The invention is concerned with improvements in or relating to writing aids. Particularly the invention relates to spacing devices the use of which enables a person to produce hand-written work of neat, tidy appearance without need to have guide-lines ruled on the paper used.

It is well known to use a straight edge device such as an ordinary ruler or T-square laid transversely of a sheet of paper, a pen or pencil being brought into contact with an upper edge of the device at the base of each letter formed. This works well enough under some circumstances, for example, when only capital letters are used, but necessitates either the temporary removal of the ruler to form the depending strokes of lower case letters such as "y", "g" and so on, or their completion after the writing is otherwise finished.

BRIEF DESCRIPTION OF INVENTION

The invention provides a spacing device for use in conjunction with a ruler device as an aid to writing, comprising a resilient spacing member mounted on or in a writing implement and adapted to maintain under a first degree of manual pressure, that is, a fixed degree of restraint, a predetermined distance between a writing point of the writing implement and an edge of a stationary ruler device positioned on a surface to be written upon, said spacing member movable under a second, increased, degree of manual pressure to reduce the distance by a predetermined amount. It will be understood that this second degree of pressure is greater than that required to hold it in the restrained position.

The idea behind this is that the user shall be aware of two "stop/feel" positions of the pen. It requires a predetermined pressure to start the stroke which allows a positive feel for the normal line of writing position.

In an embodiment of the invention the resilient spacing member is in the form of a spring steel clip attachable to the writing implement at a point spaced from the writing point and adapted to bear against the upper edge of the ruler device, when pressure is exerted to bring the spacing member into contact with a restraint portion.

In another embodiment, a resilient clip is built into the writing implement and is retractable into a body portion thereof, when not in use.

In another example, provision is made for limited movement of the spacer member lengthwise of the writing implement so that, in use, constant contact of the writing point with the writing surface is achieved.

BRIEF DESCRIPTION OF DRAWINGS

The invention will now be described in detail with reference to the accompanying drawings. It will be understood that the description is given by way of example only and not by way of limitation.

In the drawings.

DETAILED DESCRIPTION OF DRAWINGS

Figure 1:
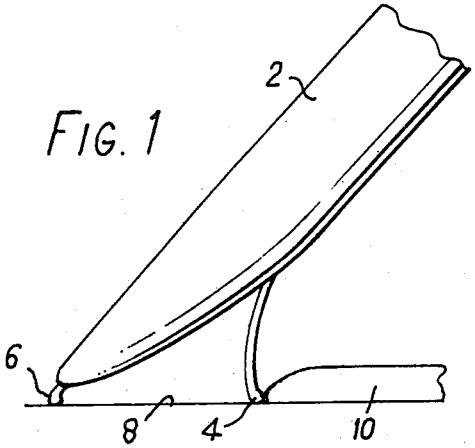
FIG. 1 shows a fragmentary view of a fountain pen equipped with a spring-biased spacing means.
Figure 4:
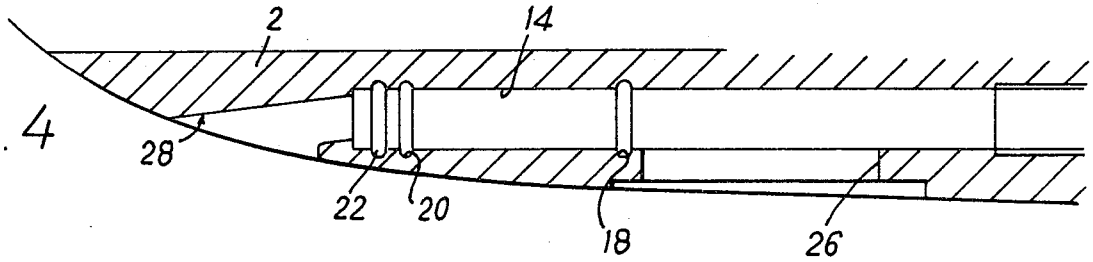
FIG. 4 is an enlarged sectional view of a portion of FIG. 2.
Figure 5:
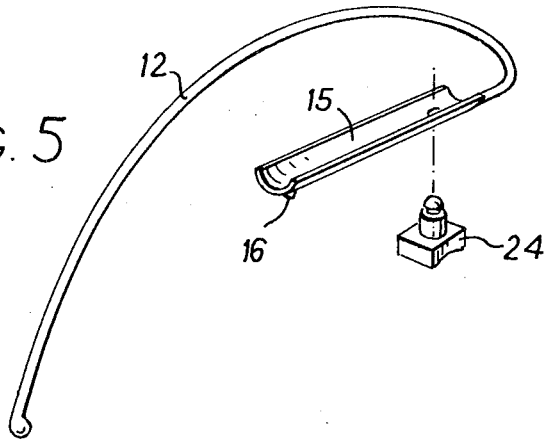
FIG. 5 is a perspective view of the spacing means.

FIG. 1 shows a fountain pen casing 2 having a spacing member 4 projecting therefrom. A nib 6 rests on a writing surface 8 at the level of the base of normally written letters having no depending strokes. A straight-edge device in the form of a conventional ruler 10 is arranged at a predetermined distance from the point of rest nib 6 as shown, this distance being governed by the "feel" of the spacing member which is formed with a spring steel arm 12 (FIGS. 2 and 5) as explained below.

The arm 12 is retractably received in a recess 14 in the casing 2, and is attached to a slide member 15 having a projection 16 receivable in a groove 18 of the recess 14 when the arm 12 (and the member 4) is retracted and in one of two alternative grooves 20, 22, as preferred by the user, in an extended condition. The retraction and extension is controlled by a serrated button 24 received in a slot 26.

Figure 3:
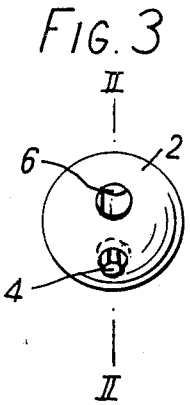
FIG. 3 is a view in the direction of arrow A of FIG. 2.
Figure 2:
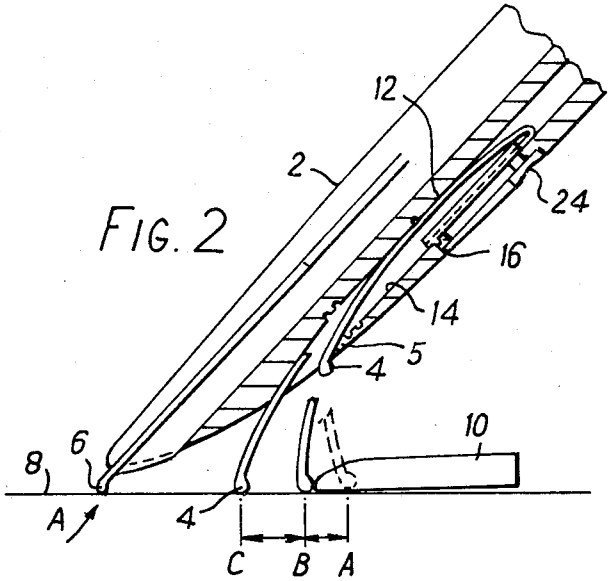
FIG. 2 is a sectional view of the pen of FIG. 1.

When extended, if it were not restrained by the casing of the pen at portion 5, the spacer member 4 on the arm 12 would take up the free unstressed position A (FIG. 2). In use the writer through the pen housing will exert an initial pressure on the member 4, which is normally restrained over part of its length 12 by the lip portion 5 of the recess 14. This initial pressure will be felt when the point of member 4 touches the ruler 10 for normal writing at position B. However, when a letter is to be written having a depending stroke, for example "y", additional pressure by the user/writer on the pen casing will move the spacing member into the fully stressed position C, thus reducing the distance between the nib and the ruler 10. This reduction is limited by the spring arm 12 abutting and pressing on the inside of the casing 2 at the region designated 28. There are thus two tangible positions of use for the pen, the normal with the initial "feel" and a further one with additional pressure.

It will be understood that the position A is the unrestrained, unstressed position of the member 4, the position B is the position the member takes up when deflected into a position determined by contact with the casing lip portion 5 and the position C is the position of greatest deflection determined by contact of the member with the region 28 of the casing.

Figure 6:
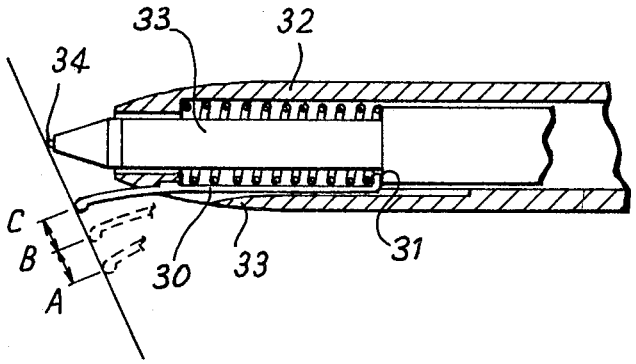
FIG. 6 is a sectional view through a ball point pen.
Figure 7:
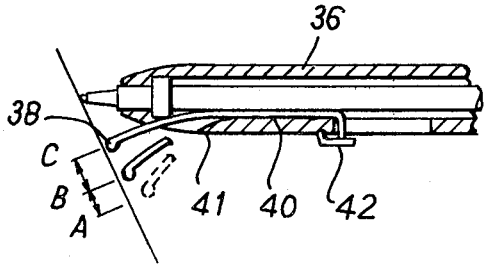
FIG. 7 is an alternative arrangement to that of FIG. 6.

FIG. 6 shows a spacer member 30 provided in the casing 32 of a retractable ball-point pen. The member is mounted for retraction and extension with the ball-tip 34. The restraint for the first "feel" position is the portion 33 of the casing. A non-retractable ball-point pen 36 is shown in FIG. 7 and in this case a spacing member 38 is shown slidably received in a recess 40 and operated by a button 42. A lip 41 of the recess provides the first position restraint.

It will be observed that the inner end portion of the member 30 abuts against a shoulder 31 of the ink refill 33 within the casing. In another example (not illustrated) the inner end portion of the member may abut a resilient support, for example, a spiral spring to allow limited movement lengthwise of the writing implement to ensure constant contact of the writing point with the writing surface, despite slight variations in the angle at which the writing instrument may be held in use.

Figure 8:
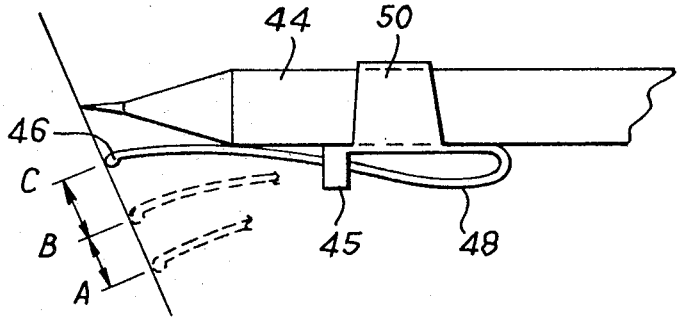
FIG. 8 shows a spacing member clipped to a pencil.

FIG. 8 shows a conventional pencil 44 provided with a spacing member 46 mounted by means of a spring arm 48 on a clip band 50 secured to the pencil. If desired, the arm may be used as a clip to retain the pencil in a pocket when not in use. A restraining portion 45 determines the first position restraint.

Figure 9:
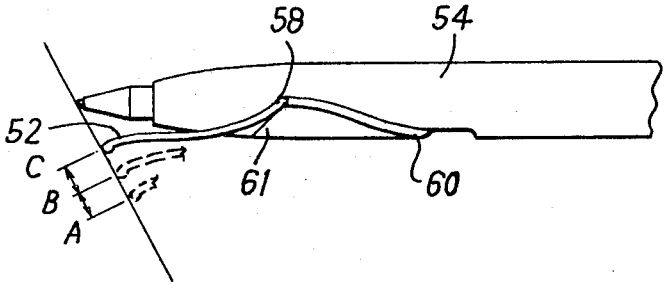
FIG. 9 shows a retractractable spacing member built into a ball point pen casing.
Figure 10:
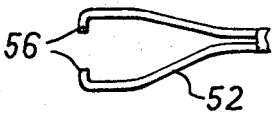
FIG. 10 shows a plan view of the member of FIG. 9.

FIG. 9 shows an alternative arrangement for a retractable spacer member 52 for use with a non-retractable ball point pen 54. In this case the spacer member is a generally Y-shaped portion of spring steel wire (see FIG. 10) and incorporates in-turned end portions 56 receivable in apertures 58 in the pen body. The member is pivotted about the end portions 56 between a forward operative position and a rearward, inoperative position in which it is received in a shaped groove 60. A forward portion of the groove incorporates two projections at 61 which restrains the member 52 in the first position.

It will be understood that the above described devices are equally suitable for use with propelling pencils, or any other writing implements.

I claim:

1. A spacing device for use in conjunction with a ruler device as an aid to writing, comprising:

a writing implement having a writing point, a first restraint, a second restraint, and a resilient spacing member joined to said writing implement and configured to abut said first restraint and maintain under a first degree of pressure a predetermined distance between said writing point of said writing implement and an edge of said ruler device, said spacing member being movable under a second, increased degree of pressure to abut said second restraint to reduce the distance between said ruler device and said writing device by a predetermined amount thereby permitting a writer to align the bottoms of normal letters of a line of script and also allow the drawing of the lower strokes of depending letters.

2. A device as claimed in claim 1, wherein said writing implement has a body portion and the member is mounted in said body portion of said writing implement and projects therefrom.

3. A device as claimed in claim 2, wherein the member is received in an elongate slot in said body portion and is retractable within the body portion when not in use.

4. A device as claimed in claim 3, wherein the amount of projection of the spacing member from the body portion is adjustable.

5. A device as claimed in claim 4, wherein the spacing member is held in a selected projecting position by engagement of a projection provided on the member with a groove provided in the body portion.

6. A device as claimed in claim 1, wherein the spacer member is pivotally mounted on the body portion of the writing implement and is movable between a forward, operative condition and a rearward, inoperative condition.

7. A device as claimed in claim 1, wherein, when not in use, the spacer member is adapted for use as a clip to retain the implement in a pocket.

* * * * *